US008322897B2

(12) United States Patent
Blincoe et al.

(10) Patent No.: US 8,322,897 B2
(45) Date of Patent: Dec. 4, 2012

(54) LIGHTING ASSEMBLIES HAVING CONTROLLED DIRECTIONAL HEAT TRANSFER

(75) Inventors: Patrick Stephen Blincoe, Kirkville, NY (US); Andrew Adams Litteer, Clay, NY (US)

(73) Assignee: Cooper Technologies Company, Houston, TX (US)

( * ) Notice: Subject to any disclaimer, the term of this patent is extended or adjusted under 35 U.S.C. 154(b) by 249 days.

(21) Appl. No.: 12/754,387

(22) Filed: Apr. 5, 2010

(65) Prior Publication Data

US 2011/0242828 A1 Oct. 6, 2011

(51) Int. Cl.
*F21V 29/00* (2006.01)

(52) U.S. Cl. ..... 362/373; 362/294

(58) Field of Classification Search ..... 362/294, 362/373

See application file for complete search history.

(56) References Cited

U.S. PATENT DOCUMENTS

| | | | | |
|---|---|---|---|---|
| 2,432,513 | A | 12/1947 | Depew | |
| 2,883,591 | A | 4/1959 | Camp | |
| 3,023,264 | A | 2/1962 | Allison | |
| 3,239,003 | A | 3/1966 | Boudette et al. | |
| 3,372,733 | A | 3/1968 | Callender | |
| 4,105,905 | A | 8/1978 | Barcus | |
| 4,715,438 | A | 12/1987 | Gabuzda et al. | |
| 4,841,422 | A | 6/1989 | Groh | |
| 5,375,652 | A | 12/1994 | Matsunaga et al. | |
| 5,397,919 | A | 3/1995 | Tata et al. | |
| 5,412,535 | A | 5/1995 | Chao et al. | |
| 5,690,424 | A | 11/1997 | Warshauer et al. | |
| 5,794,685 | A | 8/1998 | Dean | |
| 5,945,736 | A | 8/1999 | Rife et al. | |
| 6,304,451 | B1 | 10/2001 | Rife | |
| 6,330,908 | B1 | 12/2001 | Lee et al. | |
| 6,437,469 | B1 | 8/2002 | Davis et al. | |
| 6,491,091 | B1 | 12/2002 | Lin et al. | |
| 6,828,673 | B2 | 12/2004 | Ficorilli et al. | |
| 6,851,467 | B1 | 2/2005 | Bamford et al. | |
| 6,938,680 | B2 | 9/2005 | Garner et al. | |
| 6,964,501 | B2 * | 11/2005 | Ryan | 362/294 |
| 7,273,091 | B2 | 9/2007 | Bahl et al. | |
| 7,391,153 | B2 | 6/2008 | Suehiro et al. | |
| 7,438,448 | B2 | 10/2008 | Chen | |
| 7,553,047 | B2 | 6/2009 | Shin et al. | |
| 7,607,803 | B2 | 10/2009 | Zhang et al. | |
| 7,611,264 | B1 | 11/2009 | Chang et al. | |
| 7,651,245 | B2 | 1/2010 | Thomas et al. | |
| 7,712,927 | B2 | 5/2010 | Shuai et al. | |
| 7,918,587 | B2 * | 4/2011 | Hsu et al. | 362/294 |
| 8,083,374 | B2 | 12/2011 | Mo et al. | |
| 8,167,457 | B1 * | 5/2012 | Collias et al. | 362/249.05 |
| 2006/0082972 | A1 | 4/2006 | Kim | |
| 2006/0102324 | A1 | 5/2006 | Mok et al. | |
| 2006/0196636 | A1 | 9/2006 | Liu | |
| 2007/0253201 | A1 * | 11/2007 | Blincoe et al. | 362/294 |
| 2007/0253202 | A1 | 11/2007 | Wu et al. | |

(Continued)

*Primary Examiner* — Robert May

(74) *Attorney, Agent, or Firm* — King & Spalding LLP

(57) ABSTRACT

Lighting assemblies or lighting fixtures suitable for use in a hazardous location are provided. Generally, the lighting fixtures include a light source assembly, a heat sink, a driver housing or gear module, and a conductive sealing member between the light source assembly and the heat sink. The conductive sealing member has a thermal conductivity of at least about 6 Watts per meter-Kelvin, and/or a thermal impedance of less than about 0.21 degree-C. inch squared per Watt. The lighting fixtures have controlled directional heat transfer from the light source assembly to the exterior of the lighting fixture, while minimizing the heat transferred to the driver housing.

18 Claims, 5 Drawing Sheets

U.S. PATENT DOCUMENTS

| | | | | |
|---|---|---|---|---|
| 2007/0297177 | A1 | 12/2007 | Wang et al. | |
| 2008/0062703 | A1 | 3/2008 | Cao | |
| 2009/0009999 | A1 | 1/2009 | Wang et al. | |
| 2009/0067191 | A1 | 3/2009 | Faber et al. | |
| 2009/0147517 | A1 | 6/2009 | Li et al. | |
| 2009/0147520 | A1 | 6/2009 | Liu et al. | |
| 2009/0279314 | A1 | 11/2009 | Wu et al. | |
| 2010/0165632 | A1* | 7/2010 | Liang | 362/294 |
| 2010/0208432 | A1* | 8/2010 | Bhagwagar et al. | 361/717 |

* cited by examiner

LIGHTING ASSEMBLIES HAVING CONTROLLED DIRECTIONAL HEAT TRANSFER

TECHNICAL FIELD

The application relates generally to light-emitting diode (LED)-based technology lighting systems, and more particularly, to lighting assemblies or lighting fixtures having controlled directional heat transfer.

BACKGROUND OF THE INVENTION

Lighting systems utilizing LEDs are widely used in various applications including, but not limited to, hazardous area lighting, general indoor and outdoor lighting, and backlighting. Lighting systems utilizing LEDs are a longer lasting, more efficient alternative to using lighting systems utilizing conventional light sources such as incandescent lamps and fluorescent light sources. However, the implementation of LED-based lighting systems has been hindered by the amount of heat build-up within the lighting assembly. Heat build-up within the lighting assembly can reduce light output of the LEDs and shorten the lifespan of the LEDs, thus potentially causing the LEDs to fail prematurely.

Heat sinks are typically used in LED-based lighting systems. The heat sinks provide a pathway for absorbing the heat generated from LEDs in the lighting assembly, and for dissipating the heat directly or radiantly to the surrounding environment. However, conventional LED-based lighting systems employing heat sinks typically have poor heat transfer between the LEDs and the heat sink, and/or the heat drawn away from the LEDs is transferred to other heat sensitive components, such as drivers in the assembly.

Therefore, a need exists in the art for lighting assemblies having controlled directional heat transfer.

SUMMARY OF THE INVENTION

The present invention satisfies the above-described need by providing a LED-based lighting system having capabilities for controlled heat transfer from a light source assembly to an exterior of a lighting fixture, while minimizing transfer of heat to components within a driver housing.

In one aspect, a lighting fixture having controlled directional heat transfer can include a light source assembly, a heat sink, a conductive sealing member, such as a thermal gasket, positioned between the heat sink and the light source assembly, and a driver housing for containing components for controlling the lighting fixture. The conductive sealing member generally has a thermal conductivity of at least about 6 Watts per meter-Kelvin (W/mK), and/or a thermal impedance of less than about 0.21 degree-C. inch squared per Watt (° C.-in$^2$/W). The light source assembly can include an array of LEDs. The heat sink can include fins extending from a central housing of the heat sink. A nonconductive or semi-conductive sealing member, such as a silicone gasket, can be positioned between the heat sink and the driver housing so as to minimize the amount of heat transferred from the heat sink to the driver housing. Alternatively, a conduit can be to the driver housing and the heat sink to provide a gap between the driver housing and the heat sink. The conduit provides a passageway from an interior of the heat sink to an interior of the driver housing. The driver housing can be positioned at a location remote from the light source assembly and the heat sink, and be electrically coupled to the light source assembly by wiring.

In another aspect, a lighting assembly is defined that includes a light source assembly, a heat sink, and a conductive sealing member positioned between the heat sink and the light source assembly. The conductive sealing member can be a thermal gasket.

In yet another aspect, a lighting fixture is defined that includes a light source assembly, a heat sink, a gear module for containing components for controlling the lighting fixture, and a thermal gasket between the heat sink and the light source assembly. The thermal gasket generally has a thermal conductivity of at least about 6 W/mK, and/or a thermal impedance of less than about 0.21° C.-in$^2$/W. The lighting fixture can include a nonconductive or a semi-conductive sealing member, such as a silicone gasket, positioned between the heat sink and the gear module. Alternatively, the lighting fixture can include a spacer that provides a gap between the gear module and the heat sink. The gear module can also be remotely located from the light source assembly and the heat sink.

DETAILED DESCRIPTION OF THE INVENTION

Figure 1A:
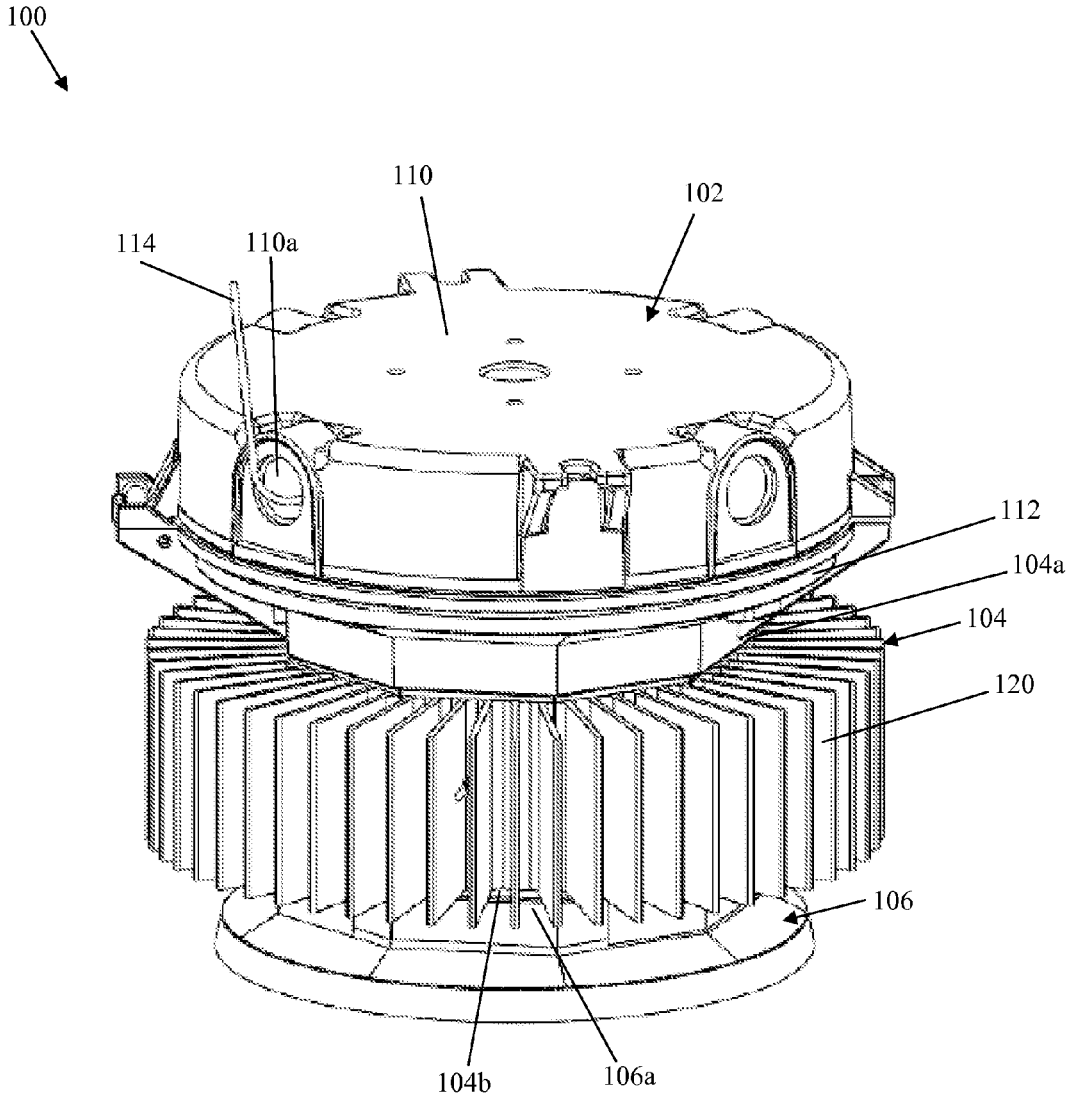
FIG. 1A is a perspective view of a lighting system, according to an exemplary embodiment.

The present invention provides LED-based technology lighting systems having controlled directional heat transfer capabilities. The lighting systems generally include an LED light source assembly, a heat sink, a conductive sealing member positioned between the LED assembly and the heat sink, and a driver housing. Generally, the conductive sealing member has a thermal conductivity of at least about 6 W/mK, a thermal impedance of less than about 0.21° C.-in$^2$/W, and/or can operate in a temperature range of from about −45° C. to about 200° C. without breaking down. In certain exemplary embodiments, the lighting systems also include a nonconductive or a semi-conductive sealing member positioned between the heat sink and the driver housing. In certain alternative exemplary embodiments, the lighting systems include a gap between the heat sink and the driver housing. The lighting systems can effectively reduce the surface temperature of the light source assembly, and improve the performance of the lighting system through controlled thermal management.

The invention may be better understood by reading the following description of non-limitative, exemplary embodiments with reference to the attached drawings wherein like parts of each of the figures are identified by the same reference characters.

FIG. 1A is a perspective view of a lighting system 100, showing components visible from an exterior, according to an exemplary embodiment. The lighting system 100 may be suitable for use in classified hazardous and/or industrial locations. The lighting system 100 includes a driver housing 102, a heat sink 104, and a LED assembly 106. In certain embodiments, the driver housing 102 is fabricated from 413 die cast aluminum alloy having a maximum of 0.4% copper. The driver housing 102 includes a mounting portion 110 hingedly coupled to a lower portion 112. The driver housing 102 houses drivers, wiring, and other components (not shown) therein for controlling the lighting system 100. The mounting portion 110 is configured for mounting the lighting system 100 to a surface, such as a ceiling, a post, or a wall. The mounting portion 110 includes openings 110*a* through which wires 114 can extend from drivers within the driver housing 102 to an external power supply (not shown). The lower portion 112 of the driver housing 102 is secured to a top end 104*a* of the heat sink 104.

Figure 1B:
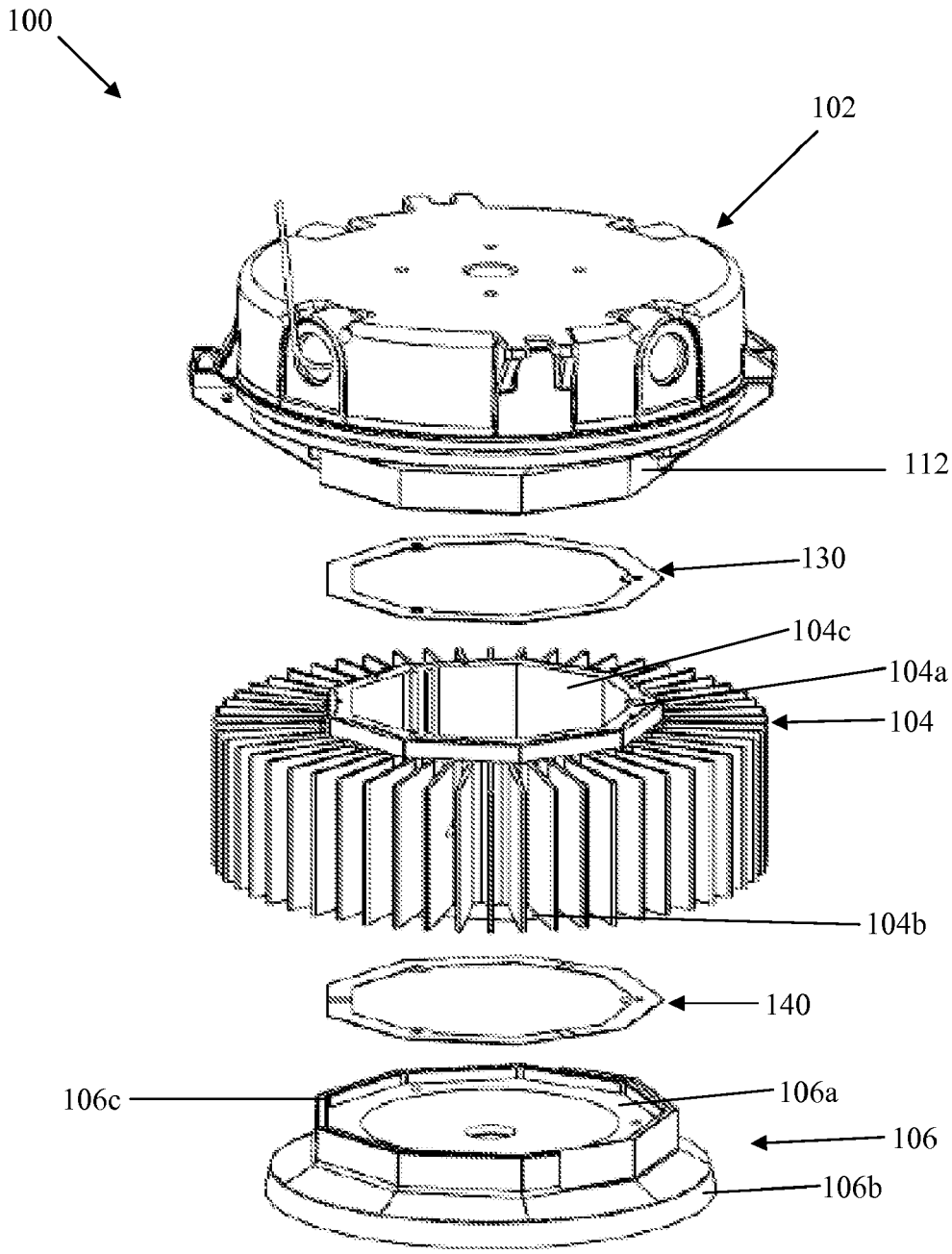
FIG. 1B is an exploded view of the lighting system of FIG. 1A, according to an exemplary embodiment.
Figure 1C:
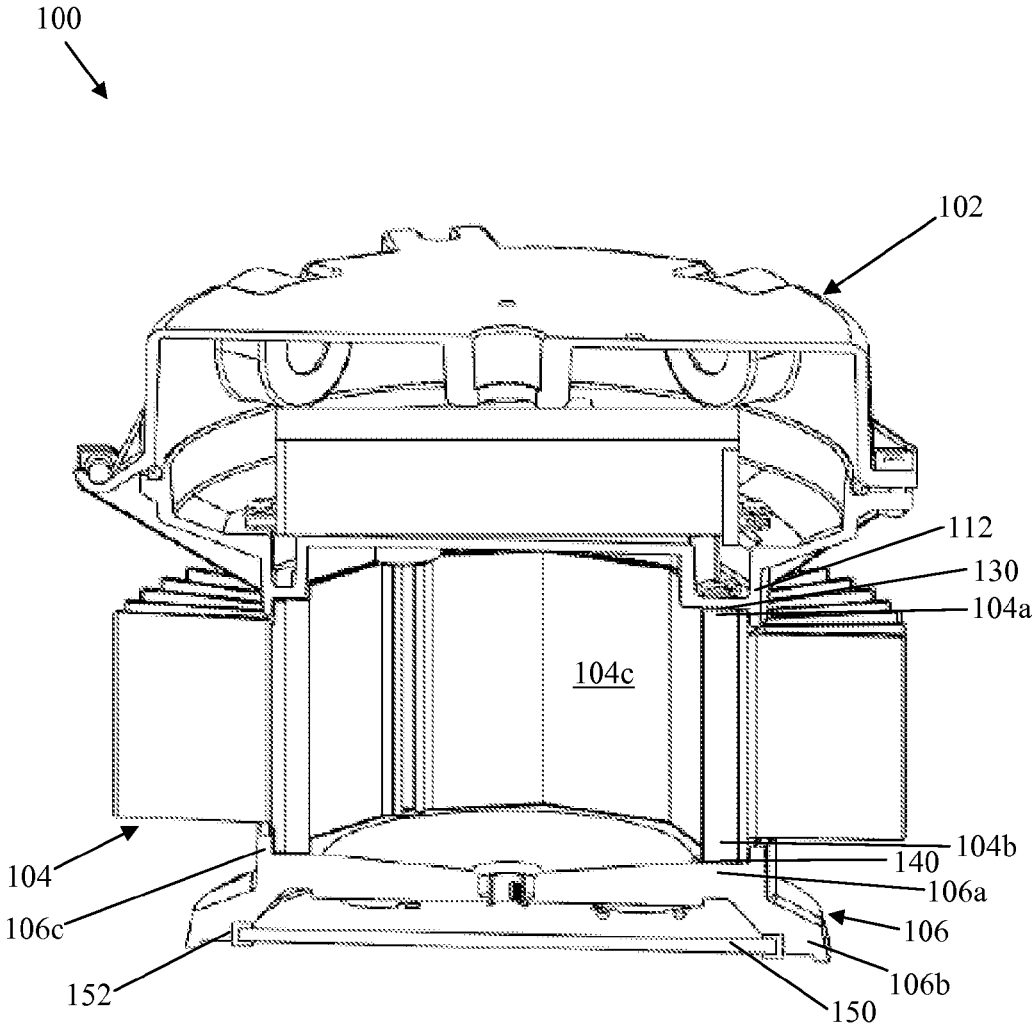
FIG. 1C is side cross-sectional view of the lighting system of FIG. 1A, according to an exemplary embodiment.

The heat sink 104 includes a central housing 104*c* (FIGS. 1B-1C). In certain exemplary embodiments, the housing 104*c* is constructed from 6061-T5 extruded aluminum. In alternative embodiments, the housing 104*c* may be constructed from a fire retardant plastic material. The heat sink 104 includes multiple vertical fins 120 extending radially outward from the housing 104*c*. In certain embodiments, the fins 120 are constructed from 6061-T5 extruded aluminum attached to the housing 104*c* with a thermally conductive epoxy and mechanically fastened with screw (not shown). In certain embodiments, the thermally conductive epoxy is a medium viscosity, aluminum filled, bonding resin. In certain embodiments, the screw provides electrical conductivity from the housing 104*c* to the fins 120. In certain embodiments, the screw is removed. In certain embodiments, the heat sink 104 is constructed as a single unit.

In certain exemplary embodiments, each of the fins 120 are equal in size. In other embodiments, the fins 120 may have different sizes. In certain other embodiments, the fins 120 may extend horizontally outward from the housing 104*c*. One having ordinary skill in the art will recognize that the fins 120 can be sized and oriented any number of ways on the heat sink 104. A bottom end 104*b* of the heat sink 104 is coupled to a top end 106*a* of the LED assembly 106. The LED assembly 106 is configured to house at least one LED (not shown) thereon. In certain exemplary embodiments, the fins 120 are flush with or recessed from an exterior of the driver housing 102 and/or from an exterior of the LED assembly 106.

FIG. 1B is an exploded view showing the components of the lighting system 100, and FIG. 1C is a side cross-sectional view of the lighting system 100, according to an exemplary embodiment. The lighting system 100 includes the driver housing 102, a semi-conductive sealing member 130, the heat sink 104, a conductive sealing member 140, the LED assembly 106, and a lens 150. In certain exemplary embodiments, the top end 104*a* and the bottom end 104*b* of the heat sink 104 have a nonagon-shaped perimeter. The semi-conductive sealing member 130 and the conductive sealing member 140 have a nonagon shape corresponding to the shape of the top end 104*a* and the bottom end 104*b*, respectively, of the heat sink 104. Similarly, the lower portion 112 of the driver housing 102 has a shape corresponding to the semi-conductive sealing member 130, and the top end 106*a* of the LED assembly 106 has a shape corresponding to the conductive sealing member 140. In certain alternative embodiments, the top end 104*a* and the bottom end 104*b* of the heat sink 104 have circular-shaped perimeter, and the semi-conductive sealing member 130 and the conductive sealing member 140 also are circular-shaped. In other embodiments, the top end 104*a* of the heat sink 104 has a shape different from the bottom end 104*b* of the heat sink 104. One having ordinary skill in the art will recognize that the top end 104*a* and the bottom end 104*b* of the heat sink 104 can be any closed circuit shape, such as circular, triangular, square, or any other polygon, and the semi-conductive sealing member 130 and the lower portion 112 of the driver housing 102, and the conductive sealing member 140 and the top end 106*a* of the LED assembly 106 will have a corresponding shape, respectively.

The semi-conductive sealing member 130 is positioned between the lower portion 112 of the driver housing 102 and the top end 104*a* of the heat sink 104. In certain alternative embodiments, the semi-conductive sealing member 130 is replaced with a nonconductive sealing member. In certain exemplary embodiments, the semi-conductive sealing member 130, the driver housing 102, and the heat sink 104 are coupled together using fastening devices, such as screws (not shown). In certain exemplary embodiments, the screws are nonconductive. In certain alternative embodiments, the screws are conductive. In certain embodiments, the semi-conductive sealing member 130, the driver housing 102, and the heat sink 104 are coupled together by clamping of the driver housing 102 to the heat sink 104. In certain embodiments, a nonconductive epoxy may be used to permanently attach the heat sink 104 to the driver housing 102, and the sealing member 130 would be removed. The semi-conductive sealing member 130 provides an environmental seal between the driver housing 102 and the heat sink 104 so as to protect the components within the driver housing 102 from direct exposure to a hazardous environment. In certain exemplary embodiments, the semi-conductive sealing member 130 is a silicone gasket. In certain embodiments, the semi-conductive sealing member 130 is a gasket constructed of polychloroprene, such as Neoprene™ rubber, a fiber gasket, or a gasket constructed of polytetrafluoroethylene (PTFE), such as Teflon™ material.

The conductive sealing member 140 is positioned between the bottom end 104*b* of the heat sink 104 and the top end 106*a* of the LED assembly 106, and is aligned with a perimeter of the bottom end 104*b* of the heat sink 104. In certain exemplary embodiments, the top end 106*a* of the LED assembly 106 includes an outer lip 106*c* that surrounds the bottom end 104*b* of the heat sink 104 when coupled together. The lip 106*c* functions to create a labyrinth seal, which increases the resistance to water ingress. The lip 106*c* can also assist in the assembly of the heat sink 104 to the LED assembly 106. In certain exemplary embodiments, the conductive sealing member 140, the heat sink 104, and the LED assembly 106 are coupled together using fastening devices (not shown). In certain exemplary embodiments, the fastening devices are conductive screws. In certain alternative embodiments, the conductive sealing member 140, the heat sink 104, and the LED assembly 106 are coupled together using adhesives. The conductive sealing member 140 provides a seal between the heat sink 104 and the LED assembly 106 so as to protect the LEDs and components within the LED assembly 106 from moisture and dust, as well as from direct exposure to a hazardous environment. In certain exemplary embodiments, the conductive sealing member 140 is a thermal gasket. In certain exemplary embodiments, the conductive sealing member 140 is fabricated from a boron nitride filled silicone elastomer, with or without fiberglass reinforcement. In certain exemplary embodiments, the conductive sealing member 140 is a crushed copper gasket. In certain exemplary embodiments, the conductive sealing member 140 has a conductivity of greater than about 6.0 W/mK, and maintains an environmental sealing. Generally, the conductive sealing member 140 has a greater conductivity, and is not as easily effected by temperatures and corrosive atmospheres as other thermal sealing members, such as thermal grease and thermal tape, would be. In certain exemplary embodiments, the conductive sealing member 140 has a thermal impedance of less than about 0.21° C.-in$^2$/W. In certain exemplary embodiments, the conductive sealing member 140 has a thickness of at least about 0.020 inch (in). In certain exemplary embodiments, the conductive sealing member 140 can operate in a temperature range of from about −45° C. to about 200° C. without breaking down.

The lens 150 is positioned at or within a bottom end 106*b* of the LED assembly 106. Light produced from the LEDs (not shown) that are mounted on the LED assembly 106 can pass through the lens 150 to illuminate an area. The lens 150 can be a clear polyvinyl cover or a glass window that protects the LEDs from direct exposure to a hazardous environment. In certain embodiments, the lens 150 sealingly engages the LED assembly 106 via an o-ring 152.

The LEDs emit heat when operating. Because of the high thermal conductivity of the conductive sealing member 140, the heat is actively transferred from the LED assembly 106 to the heat sink 104 through the conductive sealing member 140, thereby reducing the overall temperature within the LED assembly 106 and protecting the LEDs from potentially damaging heat. The presence of the nonconductive or semi-conductive sealing member 130 minimizes or eliminates heat transfer from the heat sink 104 to the driver housing 102, and thus, the heat is dissipated primarily through the fins 120 to the surrounding environment. Therefore, the components housed within the driver housing 102 are protected from exposure to potentially damaging heat. The presence of the nonconductive or semi-conductive sealing member 130 can also protect the interior from moisture and dust ingress.

Figure 2A:
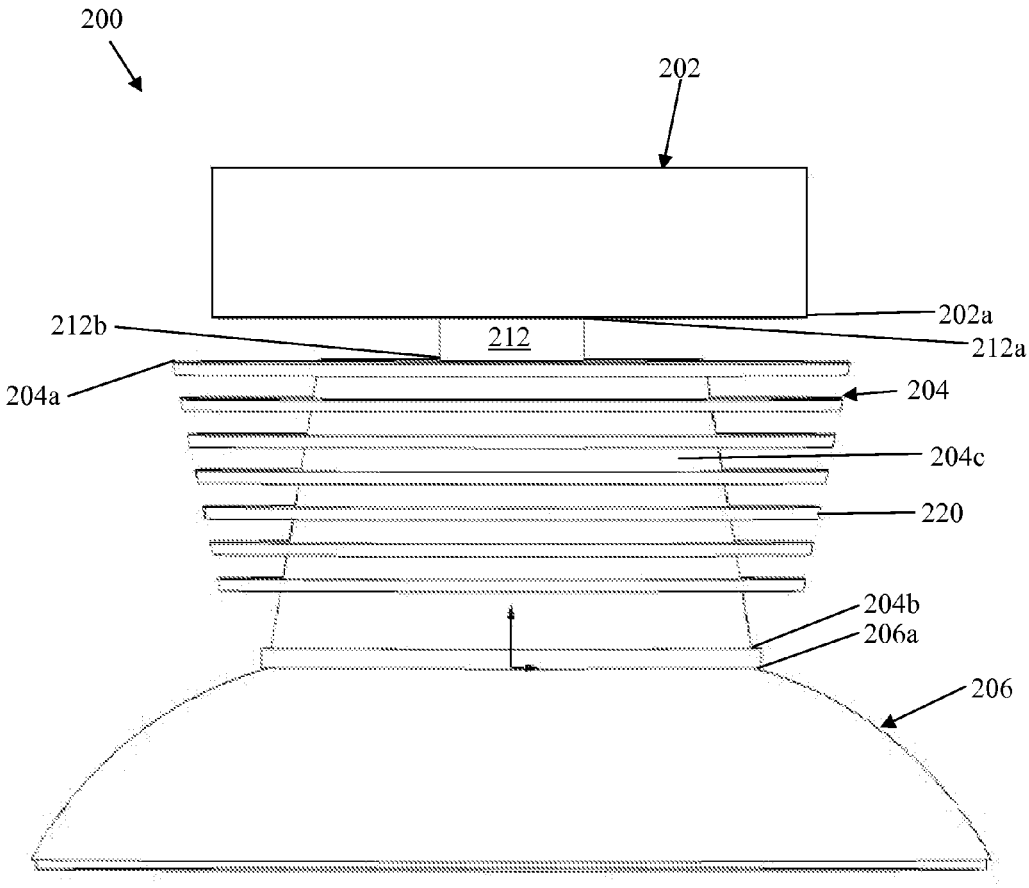
FIG. 2A a perspective view of another lighting system, according to an exemplary embodiment.

FIG. 2A is a perspective view of a lighting system 200, showing components visible from an exterior, according to another exemplary embodiment. The lighting system 200 may be suitable for use in classified hazardous and/or industrial locations. The lighting system 200 includes a gear module 202, a heat sink 204, and a light source assembly 206. In certain exemplary embodiments, the gear module 202 is constructed of 413 die cast aluminum alloy. The gear module 202 houses control gear, such as a drivers, wiring, and other components (not shown) therein for controlling the lighting system 200. In certain alternative embodiments, the components within the gear module 202 are remote from the lighting system 200, and are coupled to the lighting system 200 by wiring. A lower portion 202*a* of the gear module 202 is coupled to an end 212*a* of a conduit 212, or spacer. An opposing end 212*b* of the conduit 212 is coupled to a top end 204*a* of the heat sink 204. The conduit 212 provides a passageway from an interior of the heat sink 204 to an interior of the gear module 202. Wires (not shown) can extend from drivers within the gear module 202 through the conduit 212 and into the interior of the heat sink 204 to subsequently be coupled to a light source (not shown) within the light source assembly 206. In certain exemplary embodiments, the conduit 212 is constructed of aluminum, stainless steel, painted steel, or plastic. The heat sink 204 includes a central housing 204*c* having a cavity (not shown) therein. In certain embodiments, additional lighting components (not shown), such as a battery backup and/or a step-down transformer, may be housed within the cavity of the central housing 204*c* of the heat sink 204. The heat sink 204 includes multiple horizontal fins 220 extending radially outward from the housing 204*c*. In certain exemplary embodiments, the diameter of each of the horizontal fins 220 varies along the length of the housing 204*c*. For example, the diameter of a fin proximate to the top end 204*a* of the heat sink 204 is greater than a fin that is closer to in proximity to a bottom end 204*b* of the heat sink 204. In alternative embodiments, each of the fins 220 are equal in size. In other embodiments, the fins 220 may extend vertically outward from the housing 204*c*. One having ordinary skill in the art will recognize that the fins 220 can be sized and oriented any number of ways on the heat sink 204. In certain exemplary embodiments, the heat sink 204 may be constructed from a fire retardant plastic material. The bottom end 204*b* of the heat sink 204 is coupled to a top end 206*a* of the light source assembly 206. The light source assembly 206 is configured to house at least one light source, such as an LED, thereon.

Figure 2B:
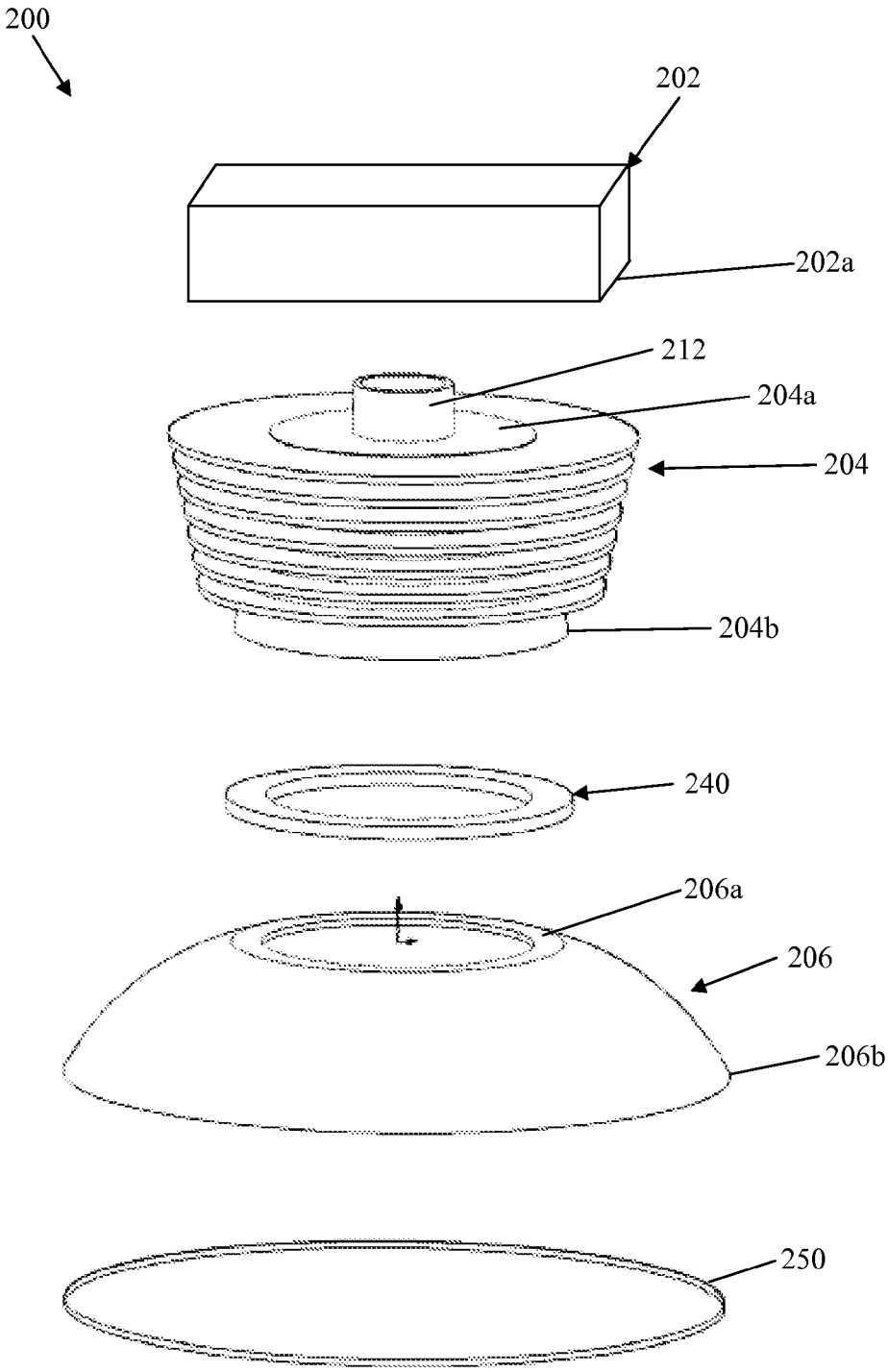
FIG. 2B is an exploded view of the lighting system of FIG. 2A, according to an exemplary embodiment.

FIG. 2B is an exploded view showing the components of the lighting system 200, according to an exemplary embodiment. The lighting system 200 includes the gear module 202, the conduit 212, the heat sink 204, a conductive sealing member 240, the light source assembly 206, and a lens 250. The conduit 212 is positioned between the lower portion 202*a* of the gear module 202 and the top end 204*a* of the heat sink 204 such that a gap is created between the gear module 202 and the heat sink 204. The gap can allow for airflow to remove heat from the heat sink 204, and prevent or minimize this heat from being transferred to the gear module 202. In certain exemplary embodiments, the gap is greater than about ⅛ inch (in).

The conductive sealing member 240 is similar to the conductive sealing member 240, the difference being in the physical structure. The conductive sealing member 240 is positioned between the bottom end 204*b* of the heat sink 204 and the top end 206*a* of the light source assembly 206. In certain exemplary embodiments, the bottom end 204*b* of the heat sink 204 has a circular-shaped perimeter. The conductive sealing member 240 also has a circular shape corresponding to the shape of the bottom end 204*b* of the heat sink 104. Similarly, the top end 206*a* of the light source assembly 206 has a shape corresponding to the conductive sealing member 240. One having ordinary skill in the art will recognize that the bottom end 204*b* of the heat sink 204 can have any closed circuit shape however, and the conductive sealing member 240 and the top end 206*a* of the light source assembly 206 will have a corresponding shape. In certain exemplary embodiments, the conductive sealing member 240, the heat sink 204, and the light source assembly 206 are coupled together using fastening devices (not shown). In certain exemplary embodiments, the fastening devices are conductive screws. In certain other embodiments, the heat sink 204 and the light source assembly 206 are coupled together by clamping, threading, or a quarter turn with locking feature. The conductive sealing member 240 provides a seal between the heat sink 204 and the light source assembly 206 so as to protect the light source and components within the light source assembly 206 from direct exposure to a hazardous environment. In certain exemplary embodiments, the conductive sealing member 240 is fabricated from a boron nitride filled silicone elastomer, with or without fiberglass reinforcement. In certain exemplary embodiments, the conductive sealing member 240 is a crushed copper gasket. In certain exemplary embodiments, the conductive sealing member 240 has has a conductivity of greater than about 6.0 W/mK, and maintains an environmental sealing. Generally, the conductive sealing member 240 has a greater conductivity, and is not as easily effected by temperatures and corrosive atmospheres as other thermal sealing members, such as thermal grease and thermal tape, would be. In certain exemplary embodiments, the conductive sealing member 240 has a thermal impedance of less than about 0.21° C.-in$^2$/W. In certain exemplary embodiments, the conductive sealing member 240 has a thickness of at least about 0.020 in. In certain exemplary embodiments, the conductive sealing member 240 can operate in a temperature range of from about −45° C. to about 200° C. without breaking down.

The lens 250 is positioned at or within a bottom end 206*b* of the light source assembly 206. Light produced from the light source (not shown) that is/are mounted on the light source assembly 206 can pass through the lens 250 to illuminate an area. The lens 250 can be a clear polyvinyl cover or a glass window that protects the LEDs from direct exposure to the hazardous environment. In certain embodiments, the lens 250 sealingly engages the light source assembly 206 via an o-ring (not shown).

The light source emits heat when operating. Because of the high thermal conductivity of the conductive sealing member 240, the heat is actively transferred from the light source assembly 206 to the heat sink 204 through the conductive sealing member 240, thereby reducing the overall temperature within the light source assembly 206 and protecting the light source from potentially damaging heat. Heat is transferred from the heat sink 204 to the exterior of the lighting system 200 via the fins 220 and the top end 204*a* of the heat sink 204. The presence of the gap 230 substantially reduces and/or may eliminate the amount of heat transferring from the heat sink 204 to the gear module 202. Therefore, the components housed within the gear module 202 are protected from exposure to potentially damaging heat.

The lighting systems of the present invention demonstrate inherent safety qualities by thermal management. To facilitate a better understanding of the present invention, the following examples of preferred embodiments are given. In no way should the following examples be read to limit or define the scope of the invention.

EXAMPLES

Example 1

A lighting fixture of the present invention was subjected to Cycling Rain and Dielectric Withstand testing per UL1598 section 16.5.2 and 17.1 (dated Sep. 17, 2008). The lighting fixture included a thermal gasket positioned between a heat sink and a LED assembly, and a silicone gasket positioned between a driver housing and the heat sink, as shown and described with respect to FIGS. 1A-1C. The thermal gasket had a thermal conductivity of 6 W/mK and a thermal impedance of 0.21° C.-in$^2$/W. The silicone gasket had a thermal conductivity of 0.22 W/mK. The lighting fixture included two LED drivers (EWC-050S119SS-0021, 50W, input voltage/current 100-240 VAC/0.7 A, 50/60 Hz, output voltage/current 21-42 VDC/1.19 A, UL, CSA, CE, IP67) commercially available from Inventronics, six LED arrays (BXRA-C1200, cool white) commercially available from Bridgelux, and a pendant mount cover (catalog number PM2) commercially available from Cooper Crouse-Hinds.

The interior of the lighting fixture was powdered, and the lighting fixture was assembled to a JM5 stanchion mount and vented. For the Cycling Rain test, three rain heads were positioned about 60 inches from the lighting fixture. The lighting fixture was operated for one hour. After one hour, the LEDs were turn off, and water was sprayed from the rain heads at a pressure 5 pounds per square inch (psi) onto the lighting fixture. After one-half hour, the LEDs were turned on again and water continued to spray on the lighting fixture for two hours. Finally, the LEDs were turned off and water continued to spray on the lighting fixture for an additional one-half hour. At the conclusion of the test, the lighting fixture was examined and no water was observed on the powdered interior of the lighting fixture.

For the Dielectric Withstand test, the LEDs were disconnected from the lighting fixture. The ambient temperature was 22 degrees Celsius and the relative humidity was at 35 percent. A Hi-pot Tester, model number 230425, commercially available from Biddle, applied a voltage of 1480 VAC to the lighting fixture for one minute. The lighting fixture was examined for arcing to determine if any breakdown had occurred. Electrical continuity was found between all of the components in the lighting fixture, and no breakdown of any components was observed.

Example 2

The environmental sealing effect of the presence of a thermal gasket in a lighting fixture of the present invention was tested. A lighting fixture including a thermal gasket positioned between a heat sink and a LED assembly, and a silicone gasket positioned between a driver housing and the heat sink, as shown and described with respect to FIGS. 1A-1C, was subjected to Marine Hose testing per UL1598A section 16 (dated Jun. 17, 2005). The thermal gasket had a thermal conductivity of 6 W/mK and a thermal impedance of 0.21° C.-in$^2$/W. The silicone gasket had a thermal conductivity of 0.22 W/mK. The lighting fixture included two LED drivers (EWC-050S119SS-0021, 50W, input voltage/current 100-240 VAC/0.7 A, 50/60 Hz, output voltage/current 21-42 VDC/1.19 A, UL, CSA, CE, IP67) commercially available from Inventronics, six LED arrays (BXRA-C1200, cool white) commercially available from Bridgelux, and a pendant mount cover (catalog number PM2) commercially available from Cooper Crouse-Hinds. The interior of the lighting fixture was powdered, and the lighting fixture was assembled to a JM5 stanchion mount and vented. A one inch diameter nozzle was positioned about 10 feet from the lighting fixture. A stream of water was directed at the lighting fixture for a duration of five minutes at 15 psi and 110 gallons per minute (gpm). At the conclusion of the test, the lighting fixture was examined and no water was observed on the powdered interior of the lighting fixture.

The test was repeated on a similar lighting fixture, but with the thermal gasket removed. The interior of the lighting fixture was powdered, and the lighting fixture was assembled to a JM5 stanchion mount and vented. A one inch diameter nozzle was positioned about 10 feet from the lighting fixture. A stream of water was directed at the lighting fixture for a duration of five minutes at 15 psi and 110 gallons per minute (gpm). At the conclusion of the test, the lighting fixture was examined, and water was observed to have entered the lighting fixture between the heat sink and the LED assembly. Approximately 300 milliliters (mL) was measured to enter the lighting fixture.

Therefore, the presence of a thermal gasket in the lighting fixture was shown to provide an environmental seal between the heat sink and the LED assembly.

Example 3

Temperature tests were performed on a lighting fixture to determine the temperature differences of the fixture components using (i) no gasket, (ii) a silicone gasket, and (iii) a thermal gasket positioned between a heat sink and a LED assembly of the lighting fixture. Each of the lighting fixtures included two LED drivers (EWC-050S119SS-0021, 50W, input voltage/current 100-240 VAC/0.7 A, 50/60 Hz, output voltage/current 21-42 VDC/1.19 A, UL, CSA, CE, IP67) commercially available from Inventronics, six LED arrays (BXRA-C1200, cool white) commercially available from Bridgelux, and a ceiling mount cover (catalog number CM2) commercially available from Cooper Crouse-Hinds.

A lighting fixture having a thermal gasket, series 220 MS2423 commercially available from Thermagon, between the heat sink and the LED assembly was mounted in a room with provisions for maintaining a constant ambient temperature. The thermal gasket had a thermal conductivity of 6 W/mK and a thermal impedance of 0.21° C.-in$^2$/W. The silicone gasket had a thermal conductivity of 0.22 W/mK. The lighting fixture was tested in environments having ambient temperatures of (i) 25 degrees Celsius, (ii) 40 degrees Celsius, and (iii) 55 degrees Celsius. Thermocouples (TC) were positioned at the following locations on the lighting fixture: (i) adjacent a first LED, (ii) adjacent a second LED, (iii) on one driver, (iv) on the other driver, (v) the interior of the LED assembly, (vi) the exterior of the LED assembly, (vii) the upper portion of a fin on the heat sink, (viii) the lower portion of a fin on the heat sink, (ix) at the silicone gasket above the heat sink, (x) at the lens gasket, (xi) on the lens, and (xii) on another part of the lens. The lighting fixture was subjected to 240 V, 90 W, 0.46 A, and the maximum temperatures from each thermocouple were recorded after the temperatures stabilized. The tests were repeated for a lighting fixture having no gasket between the heat sink and the LED assembly, and a lighting fixture having a silicone gasket, model MS1405 commercially available from Higbee, between the heat sink and the LED assembly. Results from the Temperature tests are shown in Table I below.

TABLE I

Results from Temperature Tests

| | | 25° C. Ambient | | | 40° C. Ambient | | | 55° C. Ambient | | |
|---|---|---|---|---|---|---|---|---|---|---|
| | TC Position | Thermal Gasket | No Gasket | Silicone Gasket | Thermal Gasket | No Gasket | Silicone Gasket | Thermal Gasket | No Gasket | Silicone Gasket |
| i | LED1 | 57 | 67 | 80 | 69 | 79 | 91 | 83 | 91 | 104 |
| ii | LED2 | 58 | 69 | 81 | 70 | 80 | 92 | 85 | 92 | 105 |
| iii | Driver1 | 53 | 52 | 52 | 64 | 64 | 64 | 78 | 77 | 77 |
| iv | Driver2 | 54 | 52 | 52 | 65 | 65 | 64 | 78 | 77 | 78 |
| v | Interior | 52 | 62 | 75 | 65 | 74 | 86 | 79 | 86 | 99 |
| vi | Exterior | 50 | 60 | 74 | 63 | 73 | 86 | 77 | 84 | 98 |
| vii | Upper Fin | 45 | 44 | 42 | 58 | 57 | 56 | 73 | 71 | 70 |
| viii | Lower Fin | 45 | 44 | 42 | 58 | 57 | 56 | 73 | 71 | 70 |
| ix | Upper Gasket | 46 | 44 | 43 | 59 | 58 | 56 | 74 | 71 | 70 |
| x | Lens Gasket | 49 | 59 | 72 | 62 | 71 | 84 | 76 | 83 | 96 |
| xi | Lens1 | 52 | 58 | 64 | 63 | 68 | 75 | 76 | 79 | 86 |
| xii | Lens2 | 50 | 57 | 63 | 62 | 67 | 74 | 75 | 78 | 85 |

Therefore, the presence of a thermal gasket in the lighting fixture was shown to provide an environmental seal between the heat sink and the LED assembly, and effectively draw heat away from the LED assembly.

Example 4

Vibration tests were performed on lighting fixtures of the present invention to determine if the components within the lighting fixtures could withstand vibrations. Each of the lighting fixtures tested included a thermal gasket positioned between a heat sink and a LED assembly, a silicone gasket positioned between a driver housing and the heat sink, as shown and described with respect to FIGS. 1A-1C, two LED drivers (EWC-050S119SS-0021, 50W, input voltage/current 100-240 VAC/0.7 A, 50/60 Hz, output voltage/current 21-42 VDC/1.19 A, UL, CSA, CE, IP67) commercially available from Inventronics, and six LED arrays (BXRA-C1200, cool white) commercially available from Bridgelux. The thermal gasket had a thermal conductivity of 6 W/mK and a thermal impedance of 0.21° C.-in$^2$/W. The silicone gasket had a thermal conductivity of 0.22 W/mK. Three lighting fixtures were tested: (i) having a pendant mount cover (catalog number CM2) with ¾ in NPT conduit opening and commercially available from Cooper Crouse-Hinds, (ii) having a straight stanchion mount cover (catalog number PM2) commercially available from Cooper Crouse-Hinds, and (iii) having an angle stanchion mount cover (catalog number JM2) commercially available from Cooper Crouse-Hinds. Each lighting fixture was vibrated for 35 hours using a stroboscope, 1531A/4274/4274 commercially available from Genrad, a dial indicator, C81S/N-A/I-29-ETL commercially available from Federal, and a timer/stopwatch, 810030/E3002-2/E3002-2 commercially available from Sper Scientific. At the conclusion of the tests, the lighting fixtures were examined and there was no loosening of the enclosure joints or other damage to the components of the fixtures.

Accordingly, the above examples demonstrate that the lighting fixtures of the present invention are able to effectively control the direction of heat transfer, while being suitable for use in hazardous areas.

Therefore, the present invention is well adapted to carry out the objects and attain the ends and advantages mentioned as well as those which are inherent therein. While the invention has been depicted and described by reference to embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A lighting fixture comprising:

a light source assembly configured to house a light source;

a heat sink having a central housing and a plurality of fins extending from the central housing, the central housing having a first end having a first perimeter and a second end having a second perimeter, wherein the first perimeter has a first closed circuit shape, and wherein the second perimeter has a second closed circuit shape;

a driver housing comprising a bottom end, wherein the bottom end has substantially the first closed circuit shape;

a thermally conductive sealing gasket positioned between the second perimeter of the second end of the heat sink and the light source assembly, wherein the thermally conductive sealing gasket has a shape substantially corresponding to second closed circuit shape, wherein the thermally conductive sealing gasket has a thermal conductivity of at least about 6 Watts per meter-Kelvin, wherein the thermally conductive sealing gasket provides an environmental seal between the heat sink and the light source assembly; and a thermally nonconductive sealing gasket or a thermally semi-conductive sealing gasket positioned between the first end of the heat sink and the bottom end of the driver housing and providing an environment seal between the heat sink and the driver housing.

2. The lighting fixture of claim 1, wherein the thermally semi-conductive sealing gasket comprises silicone.

3. The lighting fixture of claim 1, further comprising a conduit having a first end and a second end, wherein the first end is coupled to the driver housing, wherein the second end is coupled to the heat sink, wherein the conduit provides a passageway from an interior of the heat sink to an interior of the driver housing.

4. The lighting fixture of claim 3, herein the length of the conduit is greater than about ⅛ inch.

5. The lighting fixture of claim 1, wherein the thermally conductive sealing gasket is selected from the group consisting of boron nitride filled silicone elastomers with fiberglass reinforcement, boron nitride filled silicone elastomers without fiberglass reinforcement, and crushed copper gaskets.

6. The lighting fixture of claim 1, wherein the second closed circuit shape is circular or polygonal.

7. The lighting fixture of claim 1, wherein the driver housing is positioned at a location remote from the light source assembly and the heat sink, wherein the driver housing comprises a plurality of components, wherein said plurality of components control said light source and are electrically coupled to said light source.

8. The lighting fixture of claim 1, wherein the thermally conductive sealing gasket has a thermal impedance of less than 0.21 degree-C. inch squared per Watt.

9. A lighting assembly comprising:

a light source assembly configured to house a light source;

a heat sink having a central housing, the central housing having a top end and a bottom end, the bottom end having an outer perimeter having a first shape, and the top end having a second shape;

a thermally conductive sealing gasket positioned between the bottom end of the heat sink and the light source assembly, wherein the conductive sealing gasket has a third shape substantially corresponding to the first shape;

a driver housing having a bottom end, the bottom end having a fourth shape substantially corresponding to the second shape; and a thermally non-conductive sealing gasket or a thermally semi-conductive sealing gasket positioned between the top end of the heat sink and the bottom end of the driver housing.

10. The lighting fixture of claim 9, wherein the thermally conductive sealing gasket is selected from the group consisting of boron nitride filled silicone elastomers with fiberglass reinforcement, boron nitride filled silicone elastomers without fiberglass reinforcement, and crushed copper gaskets.

11. The lighting fixture of claim 9, wherein the thermally conductive sealing gasket has a thermal impedance of less than 0.21 degree-C. inch squared per Watt.

12. The lighting assembly of claim 9, wherein the first shape is circular or polygonal.

13. A lighting fixture comprising:

a light source assembly configured to house a light source;

a heat sink having a central housing and a plurality of fins extending from the central housing, the central housing having a top end and a bottom end, the bottom end having a first perimeter having a first closed circuit shape and the top end of the central housing having a second closed circuit shape;

a gear module configured to house components for controlling said light source of the lighting fixture, the gear module having a bottom end having the second closed circuit shape;

a thermal gasket positioned between the bottom end of the heat sink and the light source assembly, wherein the thermal gasket has a thermal conductivity of at least about 6 Watts per meter-Kelvin, a thermal impedance of less than about 0.21 degree-C. inch squared per Watt, or both, wherein the thermal gasket has the first closed circuit shape, wherein the thermal gasket provides an environmental seal between the heat sink and the light source assembly, and wherein when the lighting fixture is operating, the thermal gasket allows transfer of heat from the light source assembly towards the heat sink; and a thermally non-conductive or a thermally semi-conductive sealing gasket positioned between the top end of the central housing of the heat sink and the bottom end of the gear module, wherein the thermally non-conductive or the thermally semi-conductive sealing gasket has the second closed circuit shape, and wherein the thermally non-conductive or the thermally semi-conductive sealing gasket provides an environmental seal between the heat sink and the gear module.

14. The lighting fixture of claim 13, wherein the thermally semi-conductive sealing gasket comprises silicone.

15. The lighting fixture of claim 13, further comprising a spacer positioned between the gear module and the heat sink, wherein the spacer provides a gap between the gear module and the heat sink.

16. The lighting fixture of claim 13, wherein the gasket is selected from the group consisting of boron nitride filled silicone elastomers with fiberglass reinforcement, boron nitride filled silicone elastomers without fiberglass reinforcement, and crushed copper gaskets.

17. The lighting fixture of claim 13, wherein the gear module is positioned at a location remote from the light source assembly and the heat sink, wherein said components for controlling said light source of the lighting fixture are electrically coupled to said light source.

18. The lighting fixture of claim 13, wherein the first closed circuit shape is circular or polygonal.

* * * * *